US008152359B2

(12) United States Patent
Firey

(10) Patent No.: US 8,152,359 B2
(45) Date of Patent: Apr. 10, 2012

(54) ROTARY TAR SLURRIFIER

(76) Inventor: Joseph Carl Firey, Seattle, WA (US)

( * ) Notice: Subject to any disclaimer, the term of this patent is extended or adjusted under 35 U.S.C. 154(b) by 421 days.

(21) Appl. No.: 12/583,448

(22) Filed: Aug. 21, 2009

(65) Prior Publication Data

US 2011/0041394 A1 Feb. 24, 2011

(51) Int. Cl.
*B01F 9/00* (2006.01)

(52) U.S. Cl. ..... 366/173.1; 366/178.3; 366/180.1

(58) Field of Classification Search ..... 366/175.3, 366/178.1, 180.1
See application file for complete search history.

(56) References Cited

U.S. PATENT DOCUMENTS

| | | | | |
|---|---|---|---|---|
| 2,010,405 | A * | 8/1935 | MacIssac | 366/173.1 |
| 2,392,542 | A * | 1/1946 | Matuszak | 366/169.2 |
| 2,667,338 | A * | 1/1954 | Hemfort | 366/173.1 |
| 7,677,791 | B2 * | 3/2010 | Firey | 366/175.3 |
| 2002/0046086 | A1 * | 4/2002 | Pletz et al. | 705/14 |
| 2005/0226094 | A1 * | 10/2005 | Damhuis | 366/175.3 |
| 2008/0172934 | A1 * | 7/2008 | Firey | 44/639 |

* cited by examiner

*Primary Examiner* — David Sorkin

(57) ABSTRACT

A method for reducing tar fuel viscosity by steam heating, during slurrification in a rotary slurrifier, is described for creating slurries of many small tar particles suspended in a continuous water phase. This heating is done at pressure to avoid evaporation of the water. The tar in water slurry is evaporatively cooled by subsequent depressurization.

4 Claims, 5 Drawing Sheets

MAKEUP WATER FOR EVAPORATIVE SLURRY COOLING BY DEPRESSURIZING
mwo/mws = WATER TO SLURRIFIER / WATER IN FINAL SLURRY
mT/mws = FINAL SLURRY MASS RATIO = 1,0
TAR TO WATER
FINAL SLURRY TEMP. = 120 °F,
FINAL TANK PRESS. = 1,7 psia,
mwo/mws
2,0
1,75
1,50
1,25
1,0
200
300
400
500
WATER AND TAR TEMPERATURE INTO SLURRIFIER °F,
BOILER PRESSURE
mwo/mws
0
-100
-200
-300
-400
STEAM BOILER PRESSURE psia,

FUEL VISCOSITY VERSUS TEMPERATURE

ROTARY TAR SLURRIFIER

CROSS REFERENCES TO RELATED APPLICATIONS

The following US patents and US patent applications are closely related to the invention described herein:

1) U.S. Pat. No. 7,281,500, entitled Supplementary Slurry Fuel Atomizer and Supply System, issued 16 Oct. 2007, Firey.
2) U.S. Pat. No. 7,418,927, entitled Common Rail Supplementary Atomizer for Piston Engines, issued 2 Sep. 2008, Firey.
3) US patent application entitled, Modified Common Rail Fuel Injection System, Ser. No. 12/011,569, filed 29 Jan. 2008, Firey.
4) US patent application entitled, Rotary Residual Fuel Slurrifier, Ser. No. 11/796,714, filed 30 Apr. 2007, Firey.
5) US patent application entitled, Engine Fuels from Coal Volatile Matter, Ser. No. 12/454,640, filed 21 May 2009, Firey.
6) US patent application entitled, Coke Burning Engine, Ser. No. 12/316,571, filed 15 Dec. 2008, Firey.

The relation between these references and the invention described herein is explained in the US patent application presented herein. These references are incorporated herein by reference thereto.

BACKGROUND OF THE INVENTION

This rotary tar slurrifier invention is in the field of alternative fuels for use in diesel engines operated in our transportation industries. Specifically this invention is in the field of fuel particle in water slurry fuels, for use in medium and high speed diesel engines, derived from coal. With the possible exception of a few steam locomotives in railroad use, essentially all US surface transportation systems, railroad, tug & barge, highway truck, are powered with medium and high speed diesel engines, using largely distillate petroleum fuels as an energy source.

Experimental operation of diesel engines with pulverized coal particles suspended in water, coal water slurry, as fuels, have been carried out over a long period of time starting almost with the original development of the diesel engine. The most recent such diesel engine experiments, with coal water slurry fuels, have been sponsored by the US Department of Energy between about 1978 and 1993. Much of the experimental work was carried out by several American diesel engine manufacturers. These experimental results are summarized in the following publications together with the many references listed therein:

1) *Coal Fueled Diesel Engines,* 1993 Edited by J. A. Caton and H. A. Webb. ASME Publication ICE-Vol 19.
2) *Coal Fueled Diesel Development A Technical Review*, T. A. Ryan. ASME Paper No. 94-ICE-20, 1994.

In general acceptable diesel engine combustion and efficiency were obtained, using pilot injection of number two diesel fuel as pilot igniter fuel, in these experiments. The two principal problems were aggravated piston ring and cylinder liner wear, due to coal ash particle abrasion, and particularly, severe fuel injector nozzle wear. This severe nozzle wear was partially, though not fully, reduced, by combining the pilot fuel injection with the coal water slurry fuel injection through the same fuel injector, as described in the following reference:

3) *A New System for the Delivery and Combustion Control of Coal Slurries in Diesel Engines*, by G. Baranescu, SAE Technical Paper 890446, 1989.

Efforts to improve combustion by using smaller and more numerous coal particles, in the coal water slurry fuel, yielded disappointing results, and this has been attributed to reagglomeration of the small coal particles into larger coal particles, following injection into the diesel engine cylinder, and prior to coal particle ignition therein. This reagglomeration problem can be avoided by dissolving atomizing gases into the water phase of a fuel in water slurry, at pressures well above engine cylinder pressures during fuel injection, as described in my following US patents:

4) U.S. Pat. No. 7,281,500, Supplementary Slurry Fuel Atomizer and Supply System, Firey, 2007.
5) U.S. Pat. No. 7,418,927, Common Rail Supplementary Atomizer for Piston Engines, Firey, 2008.

It has long been recognized that our very large domestic reserves of low cost coal offer a tentatively promising means for achieving the national energy independence, needed to escape our heavy dependence on petroleum imported from nations who use their nationalized petroleum resources as an economic and political tool to serve their interests. The world petroleum market has not been a truly free market for many years, and this situation has adversely affected the United States' economy. Past efforts to use coal as a fuel for surface transportation industries have been largely unsuccessful.

SUMMARY OF THE INVENTION

A rotary tar slurrifier of this invention comprises a rotary slurrifier, similar to a rotary residual fuel slurrifier as described in U.S. patent application Ser. No. 11/796,714, entitled, Rotary Residual Fuel Slurrifier, filed 30 Apr. 2007, Joseph C. Firey, inventor. This rotary slurrifier is modified so that steam heating and pressurizing can be applied to the rotary slurrifier, and to the tar fuel and water being slurrified therein. In this way the viscosity of the tar being thrown into the continuous water phase can be greatly reduced at elevated temperatures, with the resulting tar particles being of reduced size and more numerous. The steam pressurization of the rotary slurrifier prevents evaporation of the water. The resulting hot tar particles in water slurry is transferred into hot tar in water slurry tanks where slow depressurization is used to evaporatively cool the tar particles in water slurry.

The resulting tar in water slurry can be efficiently used as fuel for medium and high speed diesel engines used in our transportation industry. Improved fuel ignition and combustion can be obtained by addition of a small number of high cetane number distillate diesel fuel particles into the slurry, via a separate rotary slurrifier.

Low cost, high viscosity tar fuels can be obtained from various sources, of which the following are examples:

1) Tars from the devolatilization of bituminous coals, as described in U.S. patent application Ser. No. 12/454,640, entitled Engine Fuels From Coal Volatile Matter, filed 21 May 2009, Joseph C. Firey, inventor.
2) Tars from the devolatilization of non-food farm harvest biomass materials, as also described in the above reference.
3) Tars separated from tar sands such as the Athabaska tar sands.

A large portion of these tar fuels can be obtained from our very large domestic coal reserves, and non-food farm biomass, a renewable energy source. Not only are these energy reserves large and domestic, they are also low cost energy sources. Per unit of energy, coal costs are roughly one tenth the cost of crude petroleum. In this way national energy independence can be achieved, at an economic advantage for our national transportation industry.

BRIEF DESCRIPTION OF THE DRAWINGS

An example rotary tar slurrifier is shown schematically in cross section in FIG. 1, with the counter rotating spinning disc shell and impact cavity shell enclosed in a steam pressure vessel container.

One form of the apparatus of the invention is shown schematically in FIG. 2, wherein the steam boiler provides a means for heating tar fuels to reduce viscosity thereof.

Figure 3:
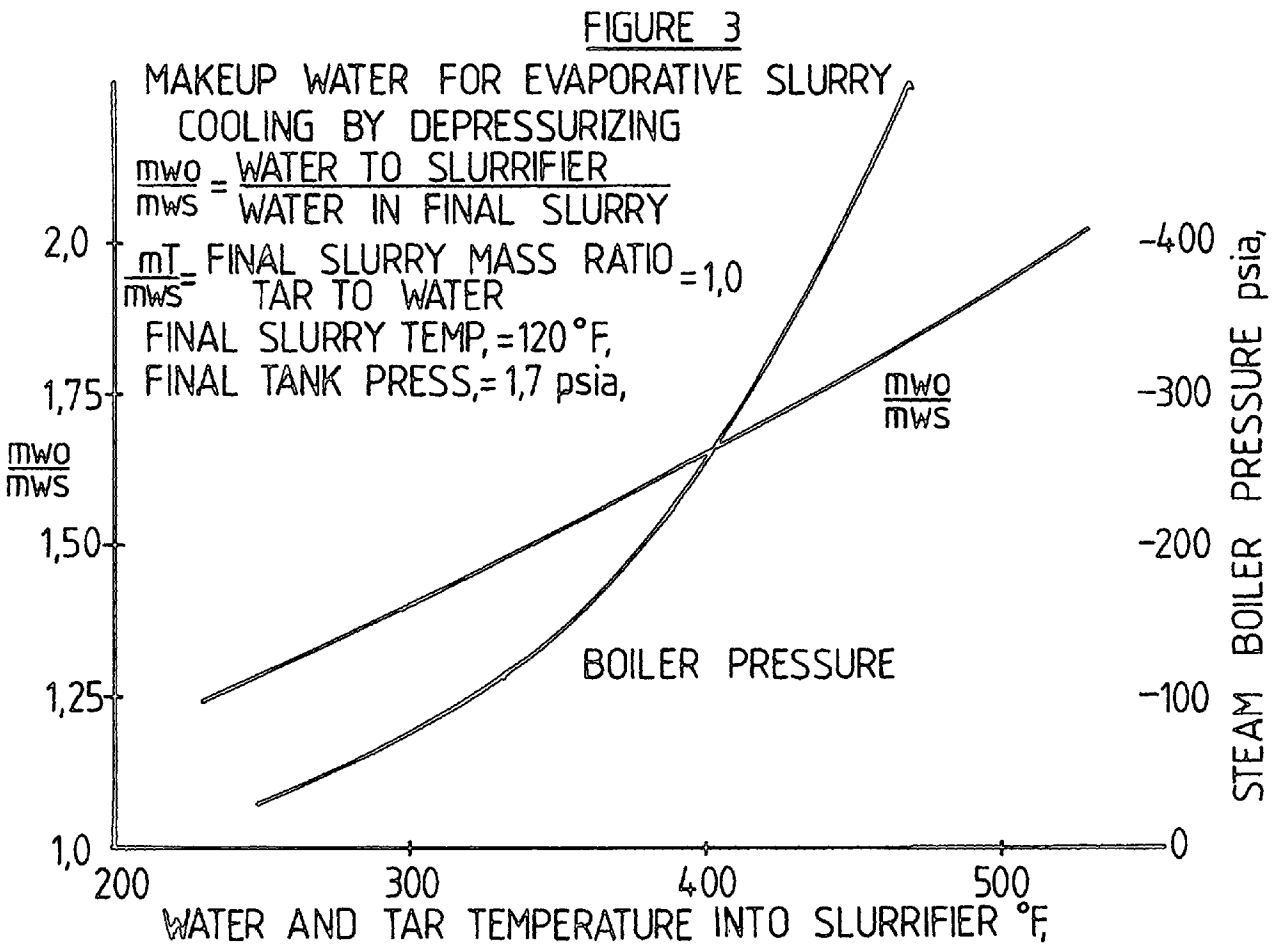

The extra water supply, needed into the slurrifier, to compensate for water loss during evaporative cooling of the finished slurry is shown on FIG. 3 as a function of the operating temperature of the slurrifier.

Figure 4:
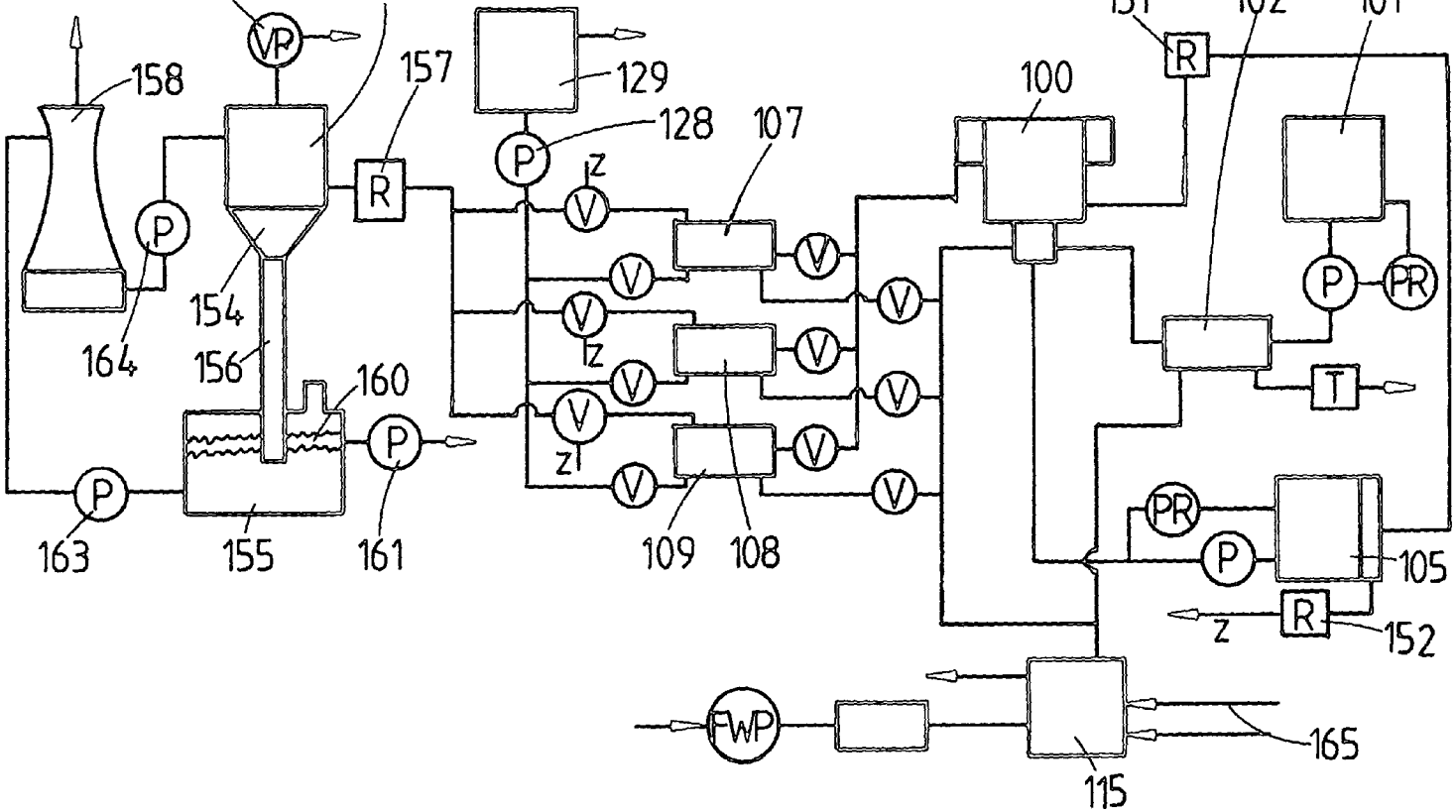

Another example form of the apparatus of this invention, is shown schematically in FIG. 4.

Figure 5:
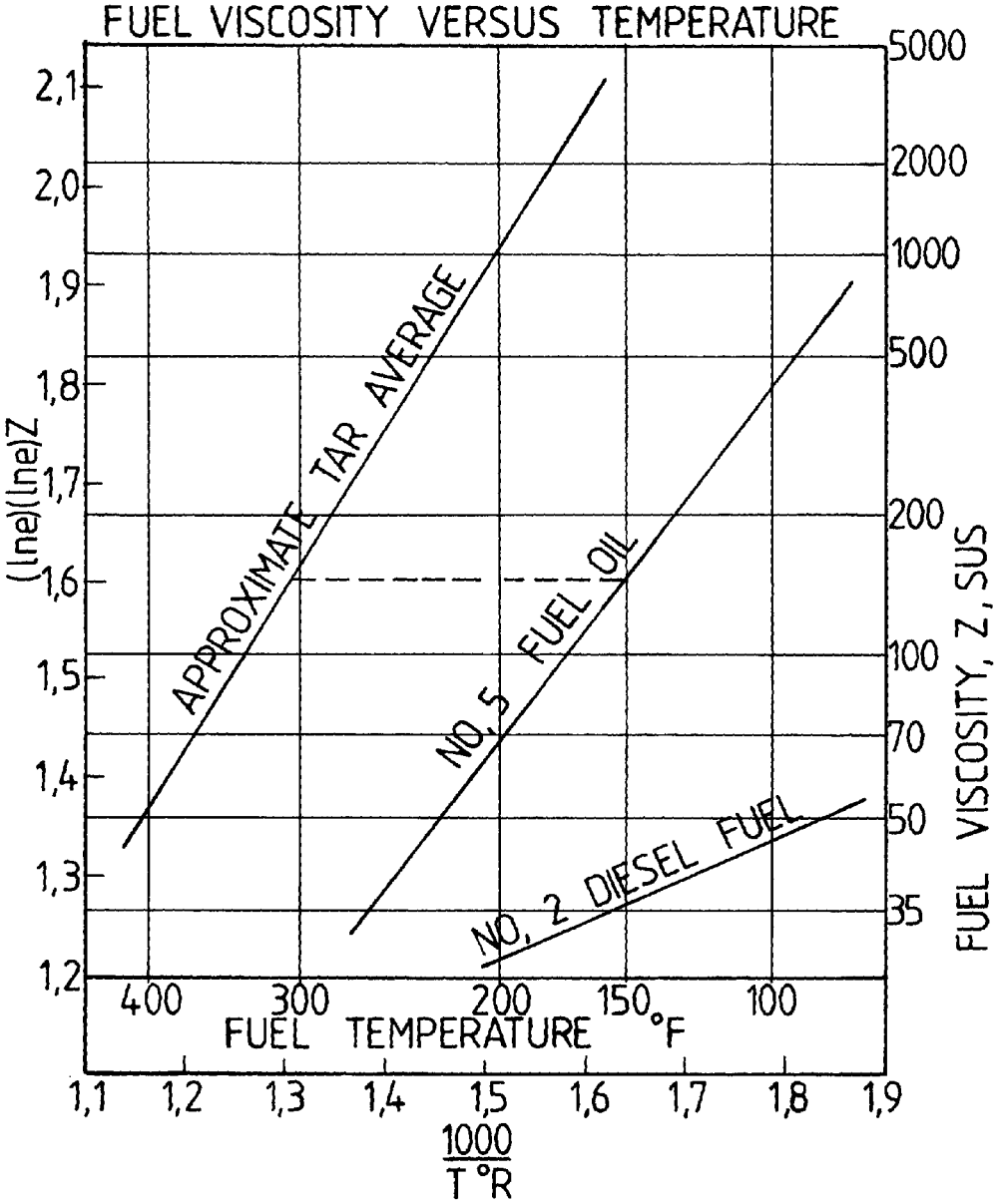

The effect of temperature on the viscosity of several typical diesel engine fuels, and approximately for tars, is illustrated on the chart of FIG. 5.

DESCRIPTION OF THE PREFERRED EMBODIMENTS

The apparatus of this invention comprises at least the following elements:

A. The rotary tar slurrifier is similar to the rotary residual slurrifiers described in my earlier filed US patent application, entitled Rotary Residual Fuel Slurrifier, Ser. No. 11/796,714, filed 30 Apr. 2007. A rotary tar slurrifier of this invention differs from a rotary residual fuel slurrifier in being equipped with a pressure vessel enclosure, so that steam can be applied throughout the slurrifier to heat and pressurize the slurrifier. This heating is used to reduce the viscosity of the tar, flowing over the paired spinning discs of the slurrifier, so that finer tar particles will be formed when the tar is thrown, by the spinning discs of the slurrifier, into the water flowing through the aligned impact cavities of the counter rotating impact cavity shell, to form the tar particle in water slurry. The pressure is needed to prevent boiling of the water flowing through the impact cavities, since tar, and hence slurrifier temperatures, well in excess of the water boiling temperature at atmospheric pressure, will be needed to slurrify many types of tars which possess very high viscosities at room temperature. Usually only a single tar fuel will be supplied to a rotary tar slurrifier of this invention. The rotary tar slurrifier will usually be operated continuously.

B. The effect of fuel temperature on fuel viscosity, and thus on fuel resistance to atomization in a rotary tar slurrifier, is illustrated in FIG. 5. As shown on FIG. 11 of my US patent application entitled Rotary Residual Fuel Slurrifier, referenced herein, a number 5 residual fuel oil can achieve atomization in a rotary slurrifier equivalent to that achieved by a number 2 diesel fuel in a diesel engine combustion chamber. With a 2 inch spinning disc, at a rotary slurrifier spinning disc RPM of 6000, a number 5 fuel matches No 2 diesel fuel engine atomization at a fuel injection pressure of about 11000 lbs per square inch with fuel at an engine temperature of about 150° F. As seen on FIG. 5 to achieve equivalent atomization of coal tar fuel, in this same rotary slurrifier, requires the tar to undergo slurrification at a temperature of at least 320° F., which is well above the atmospheric boiling temperature of the water into which the tar is to be slurrified.

C. A controlled pressure steam boiler is used for the several heating and pressurizing operations. This steam boiler can be separately fired with various fuels, including a small portion of the hot tar in water slurry fuel formed in the rotary tar slurrifier. For on board applications the steam boiler can be fired with exhaust gas from the diesel engine operating on the tar in water slurry fuel.

D. The hot tar in water slurry being formed continuously in the rotary tar slurrifier, is evaporatively cooled, in batches, in at least three hot tar in water slurry tanks. The batch process carried out in each tank comprises at least three separate steps in sequence: being filled to a preset level with hot tar in water slurry from the rotary tar slurrifier; cooling of the tar in water slurry by blowdown depressurizing the tank and evaporatively cooling the slurry; tar in water slurry is next transferred into a cooled tar in water slurry tank. With a three step sequence for this batch transfer and cooling process, three hot tar in water slurry tanks are used. In this way, at all times; one tank is receiving hot tar in water slurry from the rotary tar slurrifier; one tank is being depressurized and evaporatively cooled; and one tank is being emptied of tar in water slurry.

E. In many applications of rotary tar slurrifiers it will be preferred to evaporatively cool the hot tar in water slurry to temperatures as cool as 120° F., which is the pain threshold. With water as the evaporative coolant this requires depressurization to pressures much lower than atmospheric pressure. A vacuum pump depressurizing step can be added to the sequence of steps applied to each hot tar in water slurry tank, following the blowdown depressurizing step, and preceding the transfer step to the cooled tar in water slurry tank. A fourth hot tar in water slurry tank will be needed if this extra vacuum depressurizing and evaporative cooling step is to be used.

F. Alternatively, for evaporatively cooling the tar in water slurry to temperatures well below the atmospheric boiling temperature of water, a single blowdown step can be used, with blowdown occurring, through a flow restrictor, and into a steam condenser maintained at the required high vacuum by a vacuum pump for removal of non condensable gases. Either a surface steam condenser or a barometric steam condenser can be used.

G. For efficient use in medium and high speed diesel engines the cooled tar in water slurry in the cooled tank needs a small number of additional igniter fuel in water particles. These cannot easily be added in the high temperature rotary tar slurrifier, since these igniter fuels need to be volatile for quick evaporation in the engine. A separate unheated slurrifier can be used to add these igniter fuel particles to the cooled tar in water slurry for use of these slurry fuels in medium and high speed diesel engines.

H. Best diesel engine operation, with these tar plus igniter fuel particles in water slurry fuels, can be obtained in diesel engines equipped with common rail fuel injection systems, preferably modified for supplementary slurry fuel atomization, using atomizing gases, such as carbon dioxide, as described in my following US patents: U.S. Pat. No. 7,281,500; U.S. Pat. No. 7,418,927.

Various types of tar fuels can be supplied to the rotary tar slurrifier of this invention, in order to render these fuels usable in medium and high speed diesel engines, which cannot now operate satisfactorily on these high viscosity fuels, examples of which can be listed as follows:

(1) Coal tars from the volatile matter portions of bituminous coals.

(2) Biomass tars from the large volatile matter portions of most non-food farm harvest biomass.

(3) Tars from Athabasca tar sands.

(4) Cracked tar from petroleum refining.

(5) Heavy residual fuel from petroleum refining.

When these tar in water slurries are used in many medium and high speed diesel engines, appreciable quantities of distillate diesel fuels will be released, for use in those applications requiring distillate fuels, such as jet fuel for aircraft engines, and other military applications. In this way the apparatus of this invention can be used to carry out an appreciable step toward the national energy independence needed, not only for economic reasons, but more importantly, for sound national defense reasons.

I. The FIG. 2 Form of the Invention

One particular example rotary tar slurrifier is illustrated schematically in FIG. 2, utilizing a slurrifier, 100, with steam enclosure and pressurizing system as described hereinbelow for the FIG. 1 slurrifier. Water, from the water tank, 101, is pumped by pump, 103, at regulated pressure, into the rotating impact cavity pairs of the slurrifier, 100, via the steam heated water heater, 102, equipped with a steam trap, 104, to drain steam condensate from the water heater, 102. Hot tar from the steam jacketed tar tank, 105, is pumped by pump, 106, at regulated pressure, onto the rotating paired spinning discs of the slurrifier, 100. The tar tank steam jacket is equipped with a steam trap, 104, to drain steam condensate from the jacket.

The tar in water slurry, formed in the slurrifier, 100, is delivered into the slurry collector pan, 134, and flows from there into one of the four hot tar in water slurry tanks, 107, 108, 109, 110, one at a time, by gravity or pump, via the hot tar slurry valves, 111, 112, 113, 114, respectively.

The steam boiler, 115, is supplied with feedwater by the feedwater pump, 116, and is fired with engine exhaust gas via the flow divider, 117. The flow divider, 117, is controlled to maintain boiler pressure, 118, at a preset value above atmospheric pressure. The steam boiler, 115, delivers steam at boiler pressure to the water heater, 102, the steam jacket on the hot tar tank, 105, the interior of the slurrifier, 100, and to the interiors of the four hot tar in water slurry tanks, 107, 108, 109, 110, via slurry tank steam valves, 124, 125, 126, 127, respectively. The interior of the slurrifier, 100, is connected to a steam trap, 104, to drain steam condensate from the slurrifier, 100.

The tar in water slurry is formed continuously, at boiler pressure and temperature, in the slurrifier, 100, and remains at boiler pressure while being delivered into each hot tar in water slurry tank, 107, 108, 109, 110, one slurry tank at a time in sequence.

In this way very fine atomization of the tar in water takes place since the tar viscosity is reduced at these higher temperatures. The higher pressure in the slurrifier is needed to prevent evaporation of the water phase flowing in the rotating impact cavities.

A control and actuator system is used for opening and closing the several valves on the several hot tar in water slurry tanks, so that each hot tar in water slurry tank is carried through the following sequence of connection steps, as illustrated here for hot tar in water slurry tank, 107.

(1) Slurry tank, 107, steam valve, 124, is opened, hot tar in water slurry valve, 111, is opened, and all other valves on hot tar in water slurry tank, 107, are closed. Hot tar in water slurry is now delivered from the slurry collection pan, 134, into hot tar in water slurry tank, 107.

(2) When hot tar in water slurry tank, 107, is filled to a preset level, hot tar in water slurry valve, 111 is closed, and hot tar in water slurry is next delivered into hot tar in water slurry tank, 108. Hot tar in water slurry tank, 107, is fitted with three discharge valves: a two-way blowdown valve, 120, a vacuum pump valve, 119, and a cooled tar in water discharge valve, 121, and these valves remain closed while hot tar in water slurry tank, 107, is receiving hot tar in water slurry from the rotary tar slurrifier, 100. The two-way blowdown valve can be opened either to the blowdown flow restrictor 122, or the atmospheric vent, 167, or can be fully closed.

(3) After hot tar in water slurry tank, 107, is filled and slurry tank steam valve, 124, is closed, blowdown valve, 120, is opened to connect hot tar in water slurry tank, 107, to steam blowdown flow restrictor, 122. Steam is now slowly discharged from hot tar in water slurry tank, 107, and the pressure therein gradually decreases to atmospheric pressure. Portions of the water in the hot tar in water slurry evaporate as the pressure decreases, and the temperature of the remaining tar in water slurry is reduced by this evaporative cooling. This steam blowdown is to occur sufficiently slowly that the steam bubbles, escaping from within the hot tar in water slurry, have time to escape without causing foaming. At the end of steam blowdown, the pressure in hot tar in water slurry tank, 107, is atmospheric, and the tar in water slurry temperature is essentially at atmospheric water boiling temperature of 212° F.

(4) Further evaporative cooling of the tar in water slurry can be accomplished by closing the blowdown valve, 120, and opening the vacuum pump valve, 119, and the vacuum pump, 123, will reduce the pressure below atmospheric, and the slurry temperature below 212° F. This vacuum pump pressure and temperature reduction must also be slow to avoid foaming. A tar in water slurry temperature of 120° F., the approximate pain threshold, can be reached if the vacuum pump reduces the hot tar in water slurry tank pressure to about 1.7 psia.

(5) The now cooled tar in water slurry is next pumped out of hot tar in water slurry tank, 107, by discharge pump, 128, and delivered into cold tar in water slurry tank, 129, by closing vacuum pump valve, 119, opening slurry discharge valve, 121, and opening two way blowdown valve, 120, to atmospheric vent, 167. When hot tar in water slurry tank, 107, is thusly emptied a full hot tar in water slurry tank cycle is completed by closing slurry discharge valve, 121, and two-way blowdown valve, 120, and opening slurry tank steam valve, 124, and hot tar in water slurry valve, 111, to start the next cycle.

Each of the four hot tar in water slurry tanks, 107, 108, 109, 110, is carried in turn through the same four step sequence: filling with tar in water slurry from the slurrifier at pressure; pressure blowdown to atmospheric pressure; further depressurization at vacuum, and being emptied by the discharge pump. As a result, one hot tar slurry tank is being filled with tar in water flurry, another is undergoing blowdown to atmospheric pressure, another is being pumped out to vacuum, and another is being emptied, at all times.

These various valve control and actuator operations can be carried out by hand, in response to sensors of tank pressure and slurry level. Preferably automatic control and actuator means can be used.

Adequate final cooling of the tar in water slurry can also be achieved by use of a sufficiently large surface area, water cooled, final slurry cooling heat exchanger, 132, on the outlet side of the discharge pump, 128. With this cooling heat exchanger, the vacuum pump depressurizing step, and the vacuum pump, 123, can be eliminated.

Each hot tar in water slurry tank is fitted with a hot tar in water slurry valve, a slurry tank steam valve, a two-way blowdown valve, a vacuum pump valve, and a slurry discharge valve. These five valves can be separate for each hot tar in water slurry tank, as shown on FIG. 2, or can be combined into five multiport selector valves.

The steam discharged from each hot slurry tank during blowdown depressurization can be delivered as a heating source for a boiler feedwater heater, 133. Steam condensate from the several steam traps can be used as a portion of the boiler feedwater.

Use of tar in water slurry fuels, in diesel engines of medium or high rotational speed, will be improved by a small number of high cetane number distillate igniter fuel particles into the tar in water slurry. These few igniter fuel particles will initiate compression ignition and combustion in the diesel engine cylinder much more quickly than would the tar fuel particles alone. Such quick initiation of combustion will be needed to efficiently utilize tar in water slurry fuels in medium and high speed diesel engines.

These igniter fuel particles must be added into a cold tar in water slurry since they are volatile distillate fuels. An example apparatus for adding igniter fuel particles into the cold tar in water slurry in the cold slurry tank, 129, is illustrated schematically in FIG. 2. Igniter fuel from igniter fuel tank, 130, is pumped, at controlled pressure, from the tank, 130, into the rotating paired spinning discs of the rotary igniter fuel slurrifier, 131, and cold tar in water slurry is pumped, at controlled pressure, from the cold tar in water slurry tank, 129, into the paired rotating impact cavities of the rotary igniter slurrifier, 131. The resulting tar plus igniter fuel in water slurry can be delivered into the day tank of an operating medium or high speed diesel engine. The rotary igniter fuel slurrifier is neither pressurized nor heated by steam. This rotary igniter fuel slurrifier, 131, can be of the type described in my earlier, cross referenced, US patent application entitled Rotary Residual Fuel Slurrifier, Ser. No. 11/796,714, filed 30 Apr. 2007, and incorporated herein by reference thereto.

Figure 2:
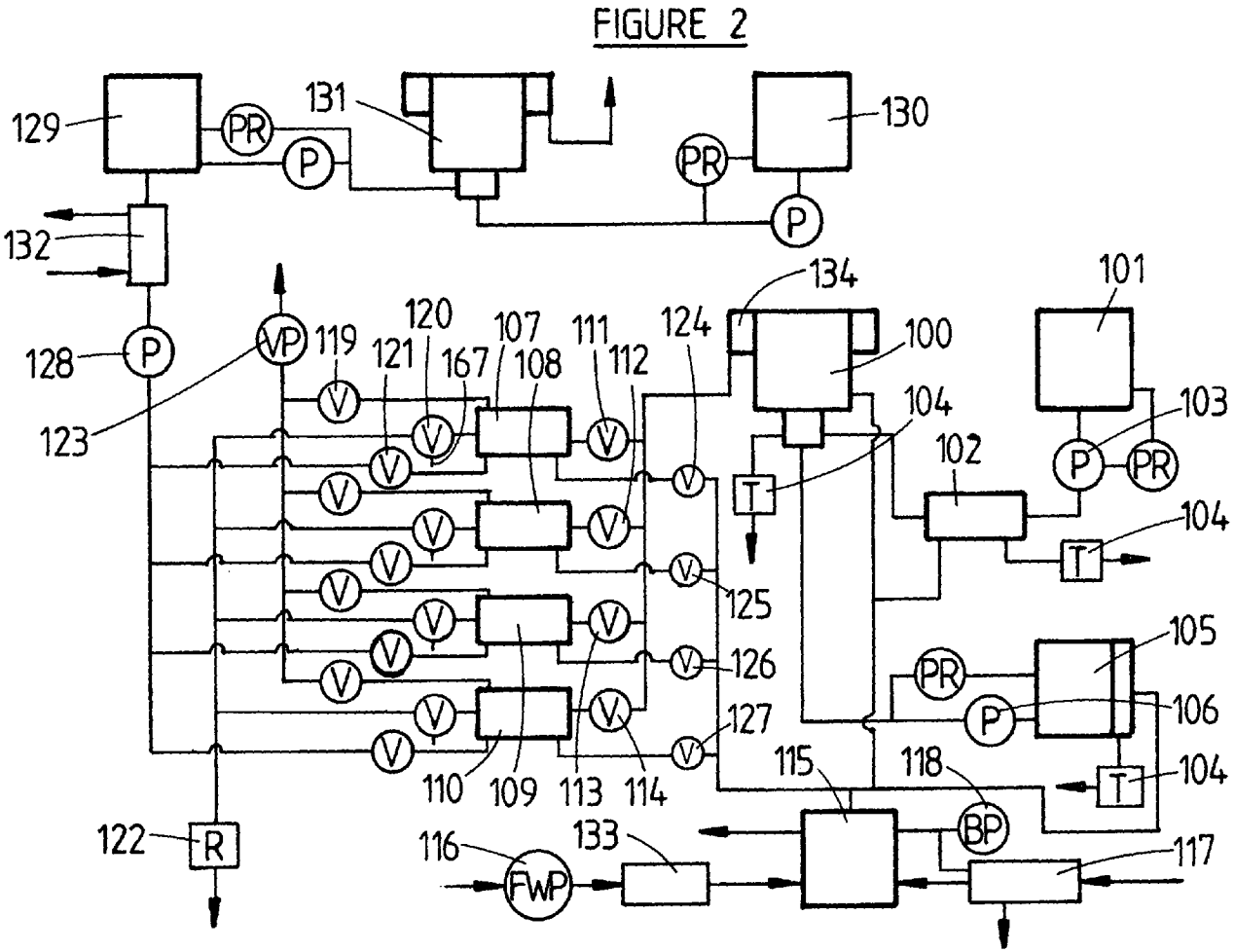

In this way the FIG. 2 form of this invention creates a slurry fuel comprising many small particles of tar fuel plus a few small particles of igniter fuel suspended in a continuous water phase.

The early compression ignition needed for high RPM diesel engines is obtained from the igniter fuel particles. The rapid fuel burnup also needed at high engine speeds, results from the many tar particles being very small, since atomization into the water took place at high tar and water temperature and reduced tar viscosity.

This tar in water slurry fuel can be efficiently burned in small and medium bore diesel engines, operating at medium and high rotational speeds, and equipped with modified common rail fuel injection systems as described in U.S. Pat. Nos. 7,281,500 and 7,418,927 as cross referenced herein. This is a principal beneficial object of this invention to provide a method for efficient diesel engine use of high viscosity tar fuels, derived from coal and biomass materials. Present diesel engines and fuel systems cannot operate efficiently on these tar fuels.

Each of the four hot tar in water slurry tanks, 107, 108, 109, 110, is preferably of large horizontal area, with a shallow slurry level when filled, in order to minimize slurry foaming during depressurization and evaporative cooling. A moderately large free volume above the slurry level when filled will prevent carryover of slurry during depressurization and evaporative cooling.

The slurry volume in each hot tar in water slurry tank when full can be estimated from the following relation:

$$(VHST)=(SFR)(tDP)$$

Wherein:

(VHST)=Hot tar in water slurry volume in each tank when filled to preset level; cu.ft.

(SFR)=Hot tar in water slurry feed rate from the rotary tar slurrifier, cu.ft. per minute.

(tDP)=Largest time interval for tank depressurization, of the blowdown step or the vacuum pump step, minutes per cycle.

A longer time interval for tank depressurization is needed, for tanks of smaller horizontal area, if foaming of the hot tar in water slurry is to be avoided during depressurization.

The water flow rate into the rotary tar slurrifier, 100, needs to be greater than that needed for the intended tar to water ratio in the final cooled tar in water slurry in the cooled slurry tank, 129, to offset the water lost during evaporative cooling by depressurization in the hot tar in water tanks, 107, 108, 109, 110. This increased water flow rate into the rotary tar slurrifier can be estimated from the following approximate relations:

$$lne\frac{\left[\left(\frac{mwo}{mws}\right)+\left(\frac{mT}{mws}\right)\right]}{\left[1+\left(\frac{mT}{mws}\right)\right]}=\left(\frac{CPW}{LHV}\right)(Ti-Tf)$$

Wherein:

$\left(\frac{mT}{mws}\right)$ = Intended product tar to water mass ratio after evaporative cooling $\left(\frac{mwo}{mws}\right)$ = Required ratio of water flow rate into rotary tar slurrifier, 100, to water flow rate into cooled slurry tank, 129.

(Ti−Tf)=Temperature decrease of tar in water slurry due to evaporative cooling during depressurization, ° F.:

(CPW)=Specific heat of tar and water assumed approximately equal, 1.0 Btu per lbsmass per degree Fahrenheit.

(LHV)=Latent heat of evaporation of water from the tar in water slurry during depressurization, Btu per lbsmass of water.

An example calculation of the ratio of water flow into the slurrifier, 100, to water flow into cooled tar in water tank, 129, is illustrated in FIG. 3 for the particular example case for the following operating factors:

(Final cooled tar in
(water slurry temperature)=120° F.

For which the final pressure reached in each hot slurry tank during depressurization is 1.7 psia.

(Product Ratio of Tar to Water)
(in cooled slurry tank, 129)=1.0

J. The Rotary Tar Slurrifier

Figure 1:
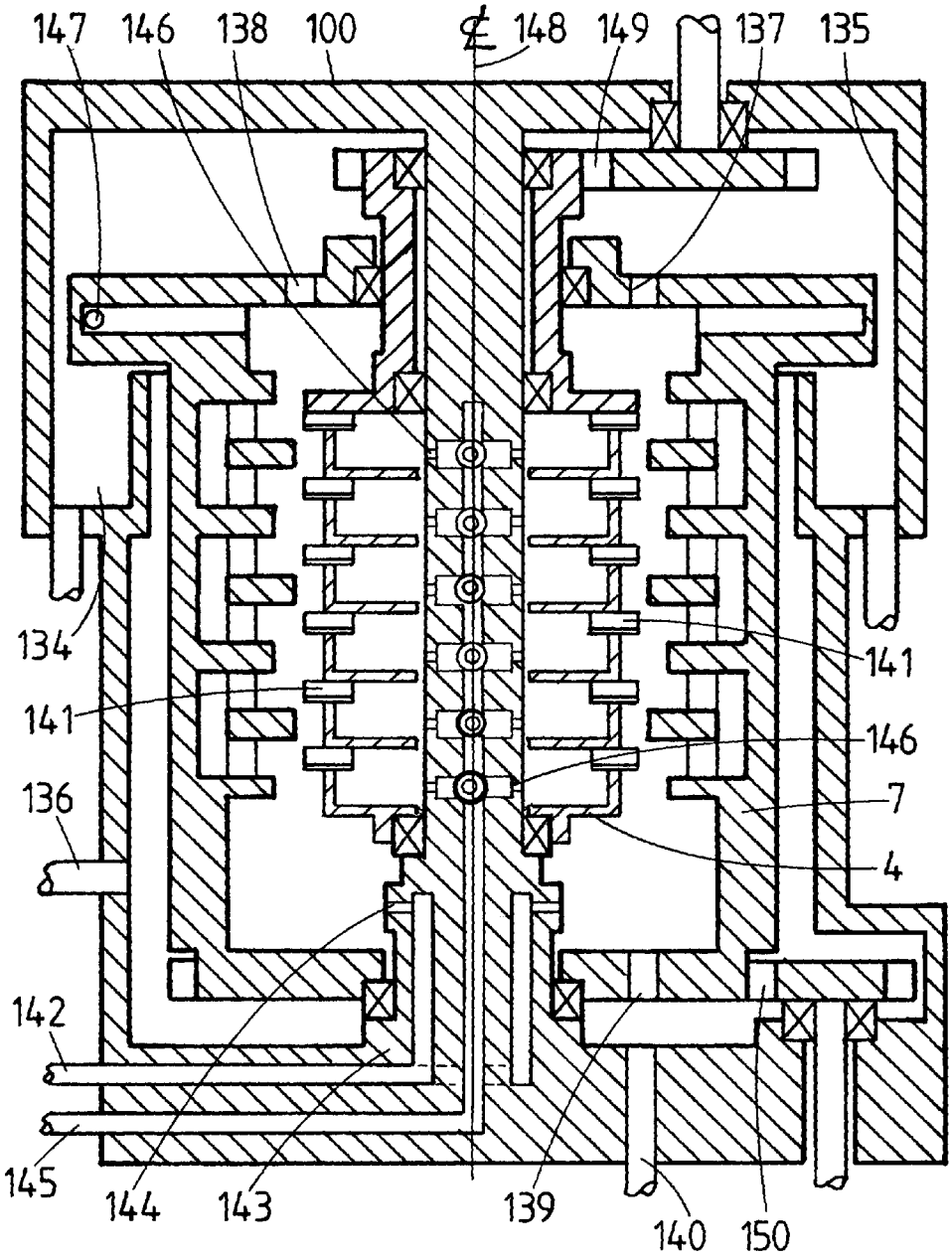

The example rotary tar slurrifier, 100, shown schematically in cross section in FIG. 1, is essentially similar to the rotary residual fuel slurrifiers described in my earlier filed US patent application entitled, Rotary Residual Fuel Slurrifier, Ser. No. 11/796,714, filed 30 Apr. 2007, and this material is incorporated herein by reference thereto.

The rotary tar slurrifier of FIG. 1 differs from the rotary residual fuel slurrifier principally in comprising a stationary pressure vessel enclosure, 135, into which high pressure steam is applied via steam flow connection, 136, from the steam boiler, 115, illustrated on FIG. 2. The enclosure, 135, fully encloses both the three pairs of rotating spinning discs on the spinning disc shell, 4, and the three pairs of aligned impact cavities, on the counter rotating cavity shell, 7. The high pressure steam, from connection, 136, freely enters the interior of the rotating cavity shell, 7, via holes, 137, 138, and steam condensate drains therefore, via holes, 139 and 140, into a steam trap. Steam condensate formation can be reduced by insulating the outer surface of the pressure vessel enclosure, 135. The high pressure steam also enters the interior of the rotating spinning disc shell, 4, via the open spaces, 141, above each spinning disc, and steam condensate, being liquid is thrown out of the spinning disc shell, 4, by the spinning discs. With these steam connections, the entire rotary tar slurrifier will be at steam pressure and temperature, where the tar fuel will be of much lower viscosity than at room temperature, and thus will be more finely atomized when thrown by the spinning discs into the water in the impact cavities. Being at pressure, the water flowing through the impact cavities will not evaporate at these higher temperatures.

Preheated water is delivered into the paired impact cavities in the rotating cavity shell, 7, via the connection, 142, to the stationary fluids manifold, 143, and the metering flow restrictors, 144, therein. Preheated tar is delivered into the rotating spinning disc shell, 4, via the connection, 145, to the fluids manifold, 143, and metering flow restrictors, 146, therein. The tar particle in water slurry produced in this rotary tar slurrifier, 100, leaves the rotating cavity shell, 7, via the reaction turbine nozzles, 147, and flows into the stationery slurry collection pan, 134, and flows from the slurry collection pan into the steam heated and pressurized hot tar in water slurry tanks, 107, 108, 109, 110, as described hereinabove for the FIG. 2 apparatus. The spinning disc shell, 4, and the rotating cavity shell, are rotated in opposite directions, at high angular velocity, about their common centerline of rotation, 148, via gears, 149, 150, and an external drive motor, not shown on FIG. 1.

K. The FIG. 4 Form of the Invention

Another example form of this invention is shown schematically in FIG. 4, and differs from the FIG. 2 form of the invention in several ways, so that tars containing appreciable portion of tar oils can be more efficiently slurrified. These tar oils have a slight volatility, and if heated at low pressure, evaporation losses can occur. The principal differences of this FIG. 4 apparatus from the FIG. 2 apparatus can be described as follows:

1) The heating and pressurizing steam goes into the rotary tar slurrifier, 100, from the steam boiler, 115, as a slow steady throughflow with flowrate controlled by the first flow restrictor, 151. This throughflow steam, at less than boiler pressure and temperature, is supplied to the steam jacket of the tar tank, 105, and flows from there, via a second flow restrictor, 152, into the steam and water mixing chamber, 153, of the barometric condenser, 154. In this way the tar in the tar tank, 105, is heated by lower temperature steam, in this FIG. 4 apparatus, than in the FIG. 2 apparatus, and volatile tar losses from the tank, 105, are reduced. Additionally, any tar oil volatile matter evaporating in the rotary tar slurrifier, 100, is delivered into the steam and water mixing chamber, 153, of the barometric condenser, 154, and these volatile tar oils can be recovered in the barometric condenser discharge tank, 155, as described hereinbelow.
2) In the FIG. 4 apparatus the barometric condenser, 154, replaces the steam boiler feedwater heater, 133, as the receiver of the blowdown steam from the hot tar slurry tanks, 107, 108, 109. By using a barometric condenser discharge pipe, 156, at least thirty-four or more feet long, a high vacuum will be obtained in the steam and water mixing chamber, 153. In this way, a separate vacuum pump steam removal step is eliminated from the sequence of steps applied to each hot tar slurry tank, 107, 108, 109. Thus the sequence of steps applied to each hot tar slurry tank consists of; first, filling with tar in water slurry from the slurrifier at pressure; second, pressure blowdown to barometric condenser vacuum via the blowdown flow area restrictor, 157; third, transfer of cooled tar in water slurry into the cold tar in water slurry tank, 129, via transfer pump, 128. With this three step sequence only three hot tar in water slurry tanks, 107, 108, 109, are needed for this FIG. 4 form of apparatus.
3) Each two way blowdown valve, 120, is shown in FIG. 4 with the vent, Z, open to atmosphere during transfer of cooled tar in water slurry out of each tank by transfer pump, 128. Alternatively this two-way blowdown valve, 120, vent connection, Z, can be connected to the reduced pressure steam flow, Z, from the rotary tar slurrifier, 100, in order to reduce air flow into the barometric condenser, 154. With this alternative connection, the reduced pressure steam flows into the tanks before entering the steam water mixing chamber, 153, of the barometric condenser.
4) In order to avoid foaming and slurry carryover during blowdown depressurization and evaporative cooling, the hot tar in water slurry tanks can be of large horizontal surface area with a shallow slurry depth. Additionally a slow time rate of depressurization can be used so that the steam bubbles, formed by evaporation within the slurry, have time to escape out of the slurry. The onset of foaming can be related to a foam index (FI), of the time rate of steam volume formation by evaporation, per unit volume of water in the tar in water slurry, and an adequately low value of foam index is to be used:

$$(FI) = \frac{\left(\frac{dVol\ \text{Steam}}{dt}\right)}{(\text{Volume liquid water})};$$

per sec.

For saturated steam, at low and moderate steam pressures, this foam index can be approximated as follows:

$$FI) = (1843)\frac{\left(\frac{dp}{dt}\right)}{(P)^2}$$

An essentially constant value of this foam index can be obtained, over the full range of blowdown pressures during depressurization by use of a constant blowdown flow restrictor, 122, 157, nozzle throat area, with sonic flow velocity at the throat. This required foam index, and blowdown nozzle throat area, can be determined experimentally, and higher values can be used the greater the ratio of tank surface area to slurry depth.
5) The blowdown steam, leaving each hot tar in water slurry tank, 107, 108, 109, during depressurization, flows into the steam and cooling water mixing chamber, 153, of the barometric condenser, 154, via the flow restrictor, 157. Cooling water, as from a cooling tower, 158, is mixed with and condenses the steam and condensable portions of any carryover tar oils, and these are discharged into the condensate receiver tank, 155, vented to atmosphere. Non condensable gases are removed from the top of the steam and cooling water mixing chamber, 153, by the vacuum pump, 159. Any condensable tar oils, 160, float on top of the cooling water and steam condensate, 161, and are removed by pump, 162, and recovered. The cooling water is recirculated via the cooling tower, 158, by pumps, 163, 164. A barometric condenser is shown in FIG. 4, but a surface condenser could alternatively be used.

6) The steam boiler, 115, in FIG. 4 is fired with a fuel and air mixture, 165, instead of the diesel engine exhaust gas used in FIG. 2. This FIG. 4 form of the invention is suited for use in a fuel preparation plant serving several diesel engine users.

INDUSTRIAL USES OF THE INVENTION

At equal fuel particle size, fluid tar particles will undergo efficient combustion, in diesel engine cylinders, at least as readily as solid coal particles. The piston ring and cylinder liner wear, due to coal ash particles will not occur when using essentially ash free tars. Tar fuels have been used for many years in large bore, slow speed, marine diesel engines without fuel injector nozzle wear problems. Thus tar fuels can be efficiently used in medium and high speed transportation diesel engines, by preatomizing the high viscosity tar into many very small particles, suspended in a continuous water phase slurry fuel, as described herein.

The needed quick ignition, of the tar particle in water slurry fuel, can be obtained by addition of a small number of separate high cetane distillate igniter fuel particles into the final slurry fuel, as described herein.

A coal tar in water diesel engine fuel will be much less expensive than conventional, largely distillate, petroleum derived, diesel engine fuels. Fuel prices vary constantly, but per unit of fuel energy, mine head coal prices are roughly one-fifth to one-tenth the prices of crude oil. Both fuels require further transport and refining costs, but these do not appreciably change the final product relative fuel cost per unit of energy.

These low cost tar particle in water slurry fuels can be used in diesel engines equipped with modified fuel injection systems. Examples of such modified diesel engine fuel injection systems are described in my following US patents and US patent applications:

a) U.S. Pat. No. 7,281,500, entitled, Supplementary Slurry Fuel Atomizer and Supply System, Fire, 2007.
b) U.S. Pat. No. 7,418,927, entitled, Common Rail Supplementary Atomizer for Piston Engines, Firey, 2008.
c) US patent application entitled, Modified Common Rail Fuel Injection System, Ser. No. 12/011,569 filed 29 Feb. 2008, Joseph C. Firey, inventor.

This material is incorporated herein by reference thereto. Diesel engines thusly modified can efficiently burn a wide variety of fuels, including conventional petroleum derived distillate fuels, as well as the tar particle in water slurry fuels described herein.

A two-step process can be used to transform portions of coal into tar particle in water slurry fuels: first to extract coal tar from the coal, and second to preatomize the tar into a tar particle in water slurry fuel. Coal tar has long been separated from bituminous coals by various devolatilization processes. One example devolatilization process, for bituminous coals, and non-food farm harvest biomass, is described in my US patent application entitled, Engine Fuels from Coal Volatile Matter, Ser. No. 12/454,640, filed 21 May 2009. This material is incorporated herein by reference thereto. These coal devolatilization processes produce several separated fuel products: a solid coke fuel; a gas fuel; a liquid hydrocarbon fuel; and a tar fuel. The relative proportions of these fuel products vary appreciably depending on the coal processed and the devolatilization process used. The solid coke fuel and the gas fuel can be burned in steam boilers for electric power generation as substitutes for coal. The solid coke fuel can also be used as fuel for coke burning engines as described in my US patent application entitled, Coke Burning Engine, Ser. No. 12/316,571, filed 15 Dec. 2008.

The liquid hydrocarbon fuel can be burned in conventional diesel engines. The tar fuel can be preatomized into a tar particle in water slurry fuel as described herein. In this way efficient utilization of the coal energy content can be achieved.

Most coal mined in America is burned in steam boilers for electric power generation. These electric power plants could install devolatilization apparatus to separate the coal into solid coke, gas volatile matter, liquid volatile matter, and tars. The solid coke fuel and the gas volatile matter can be burned in the steam boiler, and the liquid volatile matter and tars sold as diesel engine fuel.

For large diesel engine usage, such as railroad locomotives, and tug and barge operation, an on board slurrifier plant, such as the FIG. 2 example apparatus, can be used to slurrify liquid volatile matter fuel and tar fuel. For moderate diesel engine usage, such as coal mining and tar sands mining operations, a central stationary slurrifier plant, such as the FIG. 4 example apparatus, can supply several local diesel engine users.

A combined devolatilization plant, plus a slurrifier plant, could operate at a coal mine to produce solid coke products, and tar in water slurry products, for use on the diesel engines operating the mine. The gas volatile matter fuel could perhaps be polymerized into a liquid hydrocarbon fuel as is now being done with natural gas. The tar in water slurry fuels could also be sold to the railroad transporting the mine coke or coal to steam electric power plants.

In this way the American coal market could be expanded to include many medium and high speed diesel engine customers.

Tars separated from tar sands, can be directly transformed into usable diesel engine fuels by slurrification via the process described herein.

Tars and tar liquids can also be derived from biomass materials, such as non-food farm harvest materials, and logging and wood processing waste materials. Volatile matter yields from devolatilization of biomass materials are high, of the order of 70 to 80 percent by weight of the dry biomass. Gas fuels are a principal volatile matter product, with tar and tar oil yields being in the range of 25 to 50 percent by weight of the dry biomass. As with gas volatile matter fuel from coal, liquid fuel products, suitable for use in engines, can probably be prepared by polymerizing the similar volatile matter gas products from biomass. The tar and liquid tar volatile matter from biomass can also be used in diesel engines in the form of tar particle in water slurry fuels, as described herein.

Deriving engine fuels from non food farm harvest biomass, as outlined herein, makes a far more efficient use of productive farmland than do the present efforts to use ethanol, derived from food corn, as an engine fuel. Herein the food portion is not utilized for engine fuel production, and no adverse effect on food prices results. Only that portion of the non food farm harvest biomass, not needed to maintain soil fertility, is used to create engine fuels for transportation applications.

The United States can take a large step toward our much needed energy independence by using fuels, derived from our very large coal resources, to power our transportation industries. Energy independence is needed, not only to improve the economy, but more importantly for a sound national defense capability. In the next major international war the United States could easily lose access to the overseas petroleum resources from which we now derive approximately 60 percent of our transportation fuel needs. Under such circumstances our national defense capability would be seriously reduced, and might well prove inadequate to avoid our defeat.

Having thus described my invention, what I claim is:

1. A rotary tar slurrifier system for creating tar fuel slurries comprising small tar particles preatomized in a continuous water phase and comprising:

a rotary tar slurrifier;

means for heating and pressurizing the rotary tar slurrifier;

means for heating and pressurizing water being delivered from a water source into the rotating cavity shell of the rotary tar slurrifier;

means for heating and pressurizing the tar being delivered from a tar source into the rotating spinning disc shell of said rotary tar slurrifier;

means for cooling By depressurizing the tar particles in water slurry continuously produced by, and discharged from, the rotary fuel slurrifier;

said rotary tar slurrifier comprising:

at least one source of first fluid, and a separate source of second fluid, all of said first fluids being largely mutually insoluble in said second fluid;

a spinning disc shell comprising at least one pair of cylindrical spinning discs for each said first fluid, each pair of spinning discs comprising a lower spinning disc, and an upper spinning disc;

disc drive means for rotating the spinning disc shell, and all pairs of spinning discs, at high angular velocity, about a vertical spinning disc centerline of rotation and symmetry;

a rotating cavity shell, comprising a number of pairs of enclosed cylindrical impact cavities, equal to the number of pairs of spinning discs, each pair of impact cavities being flow connected together at their outer radius;

cavity shell drive means for rotating the cavity shell at a high angular velocity about a vertical cavity shell centerline of rotation and symmetry;

wherein each pair of flow connected impact cavities comprises a cylindrical entry plate, enclosing the bottom of the lower impact cavity; and a cylindrical exit plate, enclosing the top of the upper impact cavity; and a cylindrical separator block, separating the upper and lower impact cavities, and comprising flow passages, at the outer radius, connecting the lower impact cavity to the upper impact cavity of the pair;

wherein, for each pair of flow connected impact cavities, the inner radius of the cylindrical exit plate is greater than the inner radius of the cylindrical entry plate, and the inner radius of the cylindrical separator block is less than the inner radius of the cylindrical entry plate;

wherein the inner radius, of the cylindrical entry plate, of each pair of flow connected impact cavities, above a similar pair of impact cavities, is no less than the inner radius of the cylindrical exit plate of the flow connected pair of impact cavities next below;

wherein said rotating cavity shell further comprises a slowdown reaction turbine enclosed cavity, above the uppermost flow connected pair of impact cavities, and comprising a cylindrical entry plate, whose inner radius is no less than the inner radius of the cylindrical exit plate of that uppermost flow connected pair of impact cavities; and comprising symmetrical reaction turbine guide vanes, at a radius greater than the inner radius of the cylindrical entry plate of the reaction turbine cavity; the flow direction of the reaction turbine guide vanes is principally opposite to the direction of rotary motion of the cavity shell; the reaction turbine cavity further comprising an upper enclosing cylindrical plate whose inner radius is less than the inner radius of the cylindrical entry plate of the lowermost flow connected pair of impact cavities;

a stationary fluid collector pan positioned to collect fluid flowing through said reaction turbine guide vanes;

a stationary bracket means for supporting, the spinning disc shell and disc drive means, and also the rotating cavity shell and cavity shell drive means, so that the spinning disc centerline of rotation is coincident with the cavity shell centerline of rotation;

wherein the direction of rotation of the spinning disc shell is opposite to the direction of rotation of the cavity shell;

a number of separate first fluid delivery means for delivering first fluid portions on to top surfaces of said pairs of spinning discs, equal to the number of separate first fluids, each said separate fluid delivery means delivering first fluid portions from but one separate source of first fluid, and on to the top surfaces of pairs of spinning discs;

wherein said stationary support bracket means further aligns each pair of flow connected impact cavities with one pair of spinning discs receiving first fluid portions from but one source of first fluid, and further aligns each pair of flow connected impact cavities so that first fluid portions spun off the top surfaces of the aligned pair of spinning discs will enter the flow connected pair of impact cavities;

wherein each two common first fluid portions, delivered onto the two top surfaces, of each pair of spinning discs aligned with a pair of flow connected impact cavities, are essentially equal fluid portions, and are delivered essentially concurrently onto the two top surfaces; whereby centrifugal force, created by disc rotation, will cause those common first fluid portions, delivered onto the top surface of each pair of spinning discs, to be thrown off the outer radius of each spinning disc, and into the aligned flow connected impact cavities;

wherein the outer radii, of the upper and lower spinning discs of each pair, are equal and are less than the inner radius of the cylindrical entry plate, of that flow connected pair of impact cavities, with which that pair of spinning discs is aligned;

second fluid delivery means for delivering second fluid portions, from said source of second fluid, onto the top surface of the cylindrical entry plate of the bottommost flow connected impact cavity pair; whereby centrifugal force, created by cavity shell rotation, will cause those second fluid portions, delivered onto the top surface of the cylindrical entry plate of the bottommost flow connected impact cavity pair, to form into a pair of cylindrical second fluid masses, occupying all or a portion of the bottom pair of flow connected impact cavities;

and further whereby continued delivery of second fluid portions, onto the top surface of the cylindrical entry plate, of the bottommost flow connected impact cavity pair, will cause delivery of portions of second fluid upward, past the inner radius of the cylindrical exit plate of the bottommost impact cavity pair, and past the inner radius and onto the top surface of the cylindrical entry plate of the next above flow connected impact cavity pair, whereby the next above pair of impact cavities also becomes occupied, in whole or part, by a pair of rotating cylindrical masses of second fluid;

and additionally whereby continued delivery of portions of second fluid, onto the top surface of the cylindrical entry plate of the bottommost flow connected impact cavity pair, will cause a continued delivery of second fluid portions upward, into and through each successive pair of flow connected impact cavity pair above, so that all impact cavity pairs become occupied by rotating cylindrical masses of second fluid; and this continued upward delivery of second fluid continues into the slowdown reaction turbine cavity, and out of the reaction turbine cavity, via the reaction turbine flow directors and into the stationary collector pan;

finally whereby first fluid portions are thrown into the counter rotating cylindrical masses of second fluid, in the impact cavities, and the high relative velocity of impact between first fluid and second fluid atomizes the first fluid into many small particles, suspended in a continuous phase of the mutually insoluble second fluid, and this resulting slurry is slowed down and discharged into a stationary collector pan;

said means for heating and pressurizing comprising a steam boiler, operating at pressurizing pressure, with steam flow connections to said rotary fuel slurrifier, and to the means for heating and pressurizing the water flowing into the rotating cavity shell, and to said means for heating and pressurizing the tar flowing into the rotating spinning disc shell; and with valved steam flow connections to said means for cooling by depressurizing the tar particles in water slurry;

said means for cooling by depressurizing the tar particles in water slurry comprising: a number of separate hot tar in water slurry tanks; a cold tar in water slurry tank; a steam blowdown flow restrictor; a slurry discharge pump for transferring depressurized tar in water slurry from said hot tar in water slurry tanks into said cold tar in water slurry tank, one hot tar in water slurry tank at a time; a receiver of blowdown steam flowing out of the steam blowdown flow restrictor;

each said hot tar in water slurry tank comprising at least the following valved connections; a steam flow connection to said steam boiler; a blowdown connection to said blowdown flow restrictor; a hot tar in water slurry delivery connection to said stationary slurry collector pan of said rotary tar slurrifier; a depressurized tar in water slurry discharge connection to said slurry discharge pump, a vent connection;

and further comprising control and actuator means for opening and closing said several valved connections, of each hot tar in water slurry tank, so that each tank is carried through the following sequence of connections, one connection at a time:

1) a connection to the slurry collector pan of the rotary tar slurrifier to deliver hot tar in water slurry into the connected tank;

2) a following connection to the blowdown flow restrictor to depressurize the connected tank and evaporatively cool the tar in water slurry in the connected tank;

3) a next following connection to the discharge pump to transfer the cooled tar in water slurry from the connected tank into the cold slurry tank, with a concurrent connection to the vent, said control and actuator means being further operative to open and close said several valved connections of all hot tar in water slurry tanks so that at all times when the rotary tar slurrifier is continuously operating:

4) only one hot tar slurry tank is connected to the slurry collector pan of the rotary tar slurrifier;

5) only one other hot tar slurry tank is connected to the blowdown flow restrictor;

6) only one other tank is connected to said discharge pump and vent;

said number of hot tar slurry tanks being equal to the number of steps of connections in said sequence of connections;

said control and actuator means being selected from the group of control and actuator means consisting of hand control and actuator means, automatic control and actuator means, and combination hand and automatic control and actuator means;

whereby a high viscosity fuel, such as coal tar, can be atomized in water in a rotary tar slurrifier of this invention, into many very small tar particles, suspended in a continuous water phase, by increasing the tar and water temperature to reduce the tar viscosity during atomization, and tar and water temperatures in excess of the atmospheric boiling temperature of water can be used by pressurizing the slurrifier during atomization, to avoid water evaporation;

and further whereby the product hot tar in water slurry can be subsequently evaporatively cooled by a slow depressurization in hot tar slurry tanks separate from the slurrifier;

and further whereby the cooled tar in water slurry is transferred into a separate cold tar in water slurry tank where said preatomized tar in water slurry is available for use as fuel in medium and high speed diesel engines or other fuel combustion uses.

2. A rotary tar and igniter fuel slurrifier system for creating tar and igniter fuel slurries comprising many small tar particles, plus a few small igniter fuel particles, suspended in a continuous water phase, and comprising a rotary tar slurrifier system as described in claim 1, and further comprising an added, separate rotary igniter fuel slurrifier:

said separate rotary igniter fuel slurrifier comprising:

a source of high cetane number distillate diesel igniter fuel as a first fluid source;

said rotary tar slurrifier system, as described in claim 1, as a source of cold tar in water second fluid;

a spinning disc shell comprising at least one pair of cylindrical spinning discs for each said first fluid, each pair of spinning discs comprising a lower spinning disc, and an upper spinning disc;

disc drive means for rotating the spinning disc shell, and all pairs of spinning discs, at high angular velocity, about a vertical spinning disc centerline of rotation and symmetry;

a rotating cavity shell, comprising a number of pairs of enclosed cylindrical impact cavities, equal to the number of pairs of spinning discs, each pair of impact cavities being flow connected together at their outer radius;

cavity shell drive means for rotating the cavity shell at a high angular velocity about a vertical cavity shell centerline of rotation and symmetry;

wherein each pair of flow connected impact cavities comprises a cylindrical entry plate, enclosing the bottom of the lower impact cavity; and a cylindrical exit plate, enclosing the top of the upper impact cavity; and a cylindrical separator block, separating the upper and lower impact cavities, and comprising flow passages, at the outer radius, connecting the lower impact cavity to the upper impact cavity of the pair;

wherein, for each pair of flow connected impact cavities, the inner radius of the cylindrical exit plate is greater than the inner radius of the cylindrical entry plate, and the inner radius of the cylindrical separator block is less than the inner radius of the cylindrical entry plate;

wherein the inner radius, of the cylindrical entry plate, of each pair of flow connected impact cavities, above a similar pair of impact cavities, is no less than the inner radius of the cylindrical exit plate of the flow connected pair of impact cavities next below;

wherein said rotating cavity shell further comprises a slowdown reaction turbine enclosed cavity, above the uppermost flow connected pair of impact cavities, and comprising a cylindrical entry plate, whose inner radius is no less than the inner radius of the cylindrical exit plate of that uppermost flow connected pair of impact cavities; and comprising symmetrical reaction turbine guide vanes, at a radius greater than the inner radius of the cylindrical entry plate of the reaction turbine cavity; the flow direction of the reaction turbine guide vanes is principally opposite to the direction of rotary motion of the cavity shell; the reaction turbine cavity further comprising an upper enclosing cylindrical plate whose inner radius is less than the inner radius of the cylindrical entry plate of the lowermost flow connected pair of impact cavities;

a stationary fluid collector pan positioned to collect fluid flowing through said reaction turbine guide vanes;

a stationary bracket means for supporting, the spinning disc shell and disc drive means, and also the rotating cavity shell and cavity shell drive means, so that the spinning disc centerline of rotation is coincident with the cavity shell centerline of rotation;

wherein the direction of rotation of the spinning disc shell is opposite to the direction of rotation of the cavity shell;

separate first fluid delivery means for delivering first fluid portions onto the top surfaces of said pairs of spinning discs;

wherein said stationary support bracket means further aligns each pair of flow connected impact cavities with one pair of spinning discs receiving first fluid, and further aligns each pair of flow connected impact cavities so that first fluid portions spun off the top surfaces of the aligned pair of spinning discs will enter the flow connected pair of impact cavities;

wherein each two common first fluid portions, delivered onto the two top surfaces, of each pair of spinning discs aligned with a pair of flow connected impact cavities, are essentially equal fluid portions, and are delivered essentially concurrently onto the two top surfaces; whereby centrifugal force, created by disc rotation, will cause those first fluid portions, delivered onto the top surface of each pair of spinning discs, to be thrown off the outer radius of each spinning disc, and into the aligned flow connected impact cavities;

wherein the outer radii, of the upper and lower spinning discs of each pair, are equal and are less than the inner radius of the cylindrical entry plate, of that flow connected pair of impact cavities, with which that pair of spinning discs is aligned;

second fluid delivery means for delivering second fluid portions, from said source of second fluid, onto the top surface of the cylindrical entry plate of the bottommost flow connected impact cavity pair; whereby centrifugal force, created by cavity shell rotation, will cause those second fluid portions, delivered onto the top surface of the cylindrical entry plate of the bottommost flow connected impact cavity pair, to form into a pair of cylindrical second fluid masses, occupying all or a portion of the bottom pair of flow connected impact cavities;

and further whereby continued delivery of second fluid portions, onto the top surface of the cylindrical entry plate, of the bottommost flow connected impact cavity pair, will cause delivery of portions of second fluid upward, just the inner radius of the cylindrical exit plate of the bottommost impact cavity pair, and past the inner radius and onto the top surface of the cylindrical entry plate of the next above flow connected impact cavity pair, whereby the next above pair of impact cavities also becomes occupied, in whole or part, by a pair of rotating cylindrical masses of second fluid;

and additionally whereby continued delivery of portions of second fluid, onto the top surface of the cylindrical entry plate of the bottommost flow connected impact cavity pair, will cause a continued delivery of second fluid portions upward, into and through each successive pair of flow connected impact cavity pair above, so that all impact cavity pairs become occupied by rotating cylindrical masses of second fluid; and this continued upward delivery of second fluid continues into the slowdown reaction turbine cavity, and out of the reaction turbine cavity, via the reaction turbine flow directors and into the stationary collector pan;

finally whereby first fluid portions are thrown into the counter rotating cylindrical masses of second fluid, in the impact cavities, and the high relative velocity of impact between first fluid and second fluid atomizes the first fluid into many small particles, suspended in said second fluid, and this resulting slurry is slowed down and discharged into a stationary collector pan;

whereby a tar particle in water slurry fuel is created additionally containing the igniter fuel particles, needed for the early ignition of this tar in water slurry fuel, when injected as fuel into the combustion chamber of a medium or high speed diesel engine.

3. A rotary tar slurrifier system for creating tar fuel slurries comprising small tar particles preatomized in a continuous water phase, as described in claim 1, wherein said receiver of blowdown steam is one selected from the group of steam receivers: the atmosphere; the boiler feedwater heater; a barometric condenser; a surface condenser.

4. A rotary tar slurrifier system for creating tar fuel slurries comprising small tar particles preatomized in a continuous water phase, as described in claim 1, wherein said means for cooling by depressurizing the tar particles in water slurry further comprises: an additional separate hot tar in water slurry tank; a vacuum pump for transferring steam from each said hot tar in water slurry tank into said receiver of blowdown steam; each said hot tar in water slurry tank comprising an additional valved connection to said vacuum pump;

and further wherein said control and actuator means for opening and closing said several valved connections is additionally operative to interpose the additional step, in said sequence of connections, for each hot tar in water slurry tank, following said connection to said blowdown flow restrictor, of a connection to said vacuum pump;

and further wherein said control and actuator means for opening and closing said several valved connections is additionally operative so that, at all times when the rotary tar slurrifier is continuously operating, only one hot tar slurry tank is connected to said vacuum pump.

* * * * *